US006082279A

United States Patent [19]

Ito et al.

[11] Patent Number: 6,082,279

[45] Date of Patent: Jul. 4, 2000

[54] SEWING MACHINE WITH MECHANISM FOR RETRACTING FEED DOG AWAY FROM UPPER SURFACE OF NEEDLE PLATE

[75] Inventors: Minoru Ito; Masayoshi Aoyama; Kazuto Oya, all of Nagoya, Japan

[73] Assignee: Brother Kogyo Kabushiki Kaisha, Nagoya, Japan

[21] Appl. No.: 09/323,483

[22] Filed: Jun. 1, 1999

[30] Foreign Application Priority Data

Jun. 2, 1998 [JP] Japan ..... P10-153111

[51] Int. Cl.[7] ..... D05B 27/24

[52] U.S. Cl. ..... 112/314; 112/323

[58] Field of Search ..... 112/274, 284, 112/220, 314, 315, 319, 323, 324

[56] References Cited

U.S. PATENT DOCUMENTS

| | | | |
|---|---|---|---|
| 2,652,797 | 9/1953 | Amman | 112/314 |
| 2,682,243 | 6/1954 | Matuzas | 112/314 |
| 4,512,273 | 4/1985 | Skogward | 112/323 X |

FOREIGN PATENT DOCUMENTS

| | | |
|---|---|---|
| B2-61-58200 | 12/1986 | Japan . |
| B2-63-64992 | 12/1988 | Japan . |
| 4-371189 | 12/1992 | Japan . |

*Primary Examiner*—Ismael Izaguirre
*Attorney, Agent, or Firm*—Oliff & Berridge, PLC

[57] ABSTRACT

An electrically controlled sewing machine includes a needle bar, a needle plate, a feed dog, a feed dog vertical drive mechanism, a feed dog front/rear drive mechanism, an embroidery drive mechanism, and a feed dog retraction mechanism. The feed dog retraction mechanism includes a switching operation lever. The feed dog vertical drive mechanism includes a normal sewing drive cam and a retraction drive cam, which are switched between using the switching operation lever. The retraction drive cam drives the feed dog to rise upward by about 1 mm when the upper thread is being tightened, that is, at about 40° to 90° phase at the end of the thread tightening operation by the upper thread take-up lever. Because the feed dog moves upward only about 1 mm, it remains retracted below the level of the needle plate and will not interfere with movement of a workpiece cloth mounted in an embroidery frame. However, because the feed dog moves upward, the lower thread and the upper thread loop, which is being tightened at this point, can easily be pulled through the space between the connection portion at the front end of the feed dog and the vertical axis oscillating shuttle position beneath the connection portion of the feed dog. The lower thread and the upper thread loop can pass through the space without any resistance. Therefore, the thread tension will not degrade, so that attractive stitches can be formed.

20 Claims, 10 Drawing Sheets

SEWING MACHINE WITH MECHANISM FOR RETRACTING FEED DOG AWAY FROM UPPER SURFACE OF NEEDLE PLATE

BACKGROUND OF THE INVENTION

1. Field of the Invention

The present invention relates to a sewing machine provided with mechanisms for driving vertical and front-to-rear movement of a feed dog.

2. Description of the Related Art

There has been known a conventional electrically-controlled household sewing machine that stores pattern data for a plurality of embroidery patterns. The pattern data can be stored either in a ROM (non-volatile memory) of the sewing machine's control device, or in a ROM card, which is an external memory medium. Embroidery patterns corresponding to the pattern data are displayed on a display of the sewing machine. The user can switch through display of different patterns to select a desired pattern. With this configuration, users can select not only practical patterns, such as straight line stitches or zigzag stitches, but also embroidery patterns. The sewing machine then sews a pattern based on the sewing data corresponding to the selected pattern.

A sewing machine forms stitches in the following manner. First, the sewing needle is driven to move downwards, thereby drawing upper thread from an upper thread spool. When the needle is driven to move upwards, the upper thread forms a loop at the eye of the needle. The loop taker beak of a horizontally disposed loop taker or other loop taker catches the loop of the upper thread loop that extends through the eye of the sewing needle. The loop taker then passes the lower thread through the loop. Then, a thread take up lever is driven to move upward, to tighten the upper thread loop around the lower thread.

The sewing machine includes a feed dog for transporting the workpiece cloth when a practical pattern is to be sewn. In this case, after the workpiece cloth is placed on the needle plate of the bed portion of the sewing machine, the feed dog first protrudes through a slot in the needle plate, that is, above the upper surface of the needle plate, and then moves backward, thereby drawing the workpiece cloth backwards. Then, the feed dog drops below the upper surface of the needle plate and moves forward. Once the feed dog has moved forward, it again protrudes above the upper surface of the needle plate and moves backward. The workpiece cloth is transported by these four movements of the feed dog.

On the other hand, when an embroidery pattern is to be sewn, the workpiece cloth is mounted in a sewing pattern frame which is mounted on the bed portion. The embroidery frame is driven to move forward, rearward, leftward, and rightward to move the workpiece cloth to a desired position with respect to the sewing needle. Because the feed dog is not needed during embroidery sewing, a feed dog retracting mechanism is provided for retracting the feed dog below the needle plate. The feed dog retracting mechanism maintains the feed dog in this retraction position during embroidery sewing. This also prevents the feed dog from interfering with movement of the workpiece cloth supported in the embroidery frame.

Japanese Patent-Application Publication No. SHO-63-64992 discloses a sewing machine capable of sewing embroidery patterns. A feed dog lowering device is provided for retracting the feed dog below the level of the needle plate by driving a solenoid to disrupt transmission of drive force for vertically moving the feed dog. When the sewing machine is set to its embroidery mode for sewing embroidery patterns, the solenoid is driven to retract and maintain the feed dog, via the feed dog lowering device, into a fixed retraction position.

Japanese Patent-Application Publication No. HEI-4-371189 discloses a sewing machine provided with a feed dog vertical drive mechanism including a cam body fixed to the lower shaft of the sewing machine. The cam body has two integral cams: an eccentric cam and a concentric cam. A vertical movement lever linked with the feed dog is disposed in confrontation with the cam body. During sewing of practical patterns, the vertical movement lever abuts against the eccentric cam so that rotation of the eccentric cam vertically moves the feed dog above and below the level of a needle plate. On the other hand, during sewing of embroidery patterns, the vertical movement lever is brought into confrontation with the concentric cam. Because the concentric cam has a small diameter, the vertical movement lever is lowered so that the feed dog is retracted below the needle plate into a retracted condition. Because the concentric cam is concentric, the feed dog is maintained stably in the retracted condition.

Japanese Patent-Application Publication No. SHO-61-58200 discloses a sewing machine with a movable blade that passes between the feed dog and the loop taker in order to cut a thread suspended between the feed dog and the loop taker. When the movable blade is moved to cut the thread, the feed dog is raised up to prevent the feed dog and a movement blade from interfering with each other when the thread is cut.

SUMMARY OF THE INVENTION

When the thread take-up lever is raised up to tighten the upper thread loop around the lower thread, the upper thread loop (inserted with the lower thread) passes between a tip of the feed dog and the loop taker, which is provided below the feed dog. However, as mentioned above, the devices disclosed in Japanese Patent-Application Publication Nos. SHO-63-64992 and HEI-4-371189 are designed to retract the feed dog below the level of the needle plate into a retraction position during embroidery sewing, in order to prevent the feed dog from interfering with transport movement of the workpiece cloth during.

Therefore, the space between the feed dog and the loop taker is very narrow, and the upper thread loop and the lower thread can not be easily pulled out from the space below the feed dog when the upper thread loop is tightened. That is, the upper thread loop and the lower thread must be simultaneously pulled out from the space against resistance generated by contact with the feed dog. This resistance prevents the upper thread from being properly tightened. Instead, when the thread take-up lever nears its uppermost position, an excessive amount of upper thread is drawn from the upper thread spool. The thread take up lever can not sufficiently tighten the excessive amount of upper thread. Because the upper thread can not be properly tightened, unattractive poor stitches result.

It is conceivable that the amount that the feed dog is retracted below the level of the needle plate be regulated to the minimum amount required for the upper thread and the lower thread to pass through. However, variation in the height of the feed dog in the retraction position and positional errors that occur when attaching the feed dog can reduce the space to less than the minimum required amount, so that sufficient space between the loop taker and the feed dog can not be secured.

It is conceivable to retract the feed dog to a position back behind the loop taker during embroidery sewing. However, this would require a separate mechanism for moving the feed dog back behind the loop taker, which would increase the size and cost of the sewing machine.

It is an objective of the present invention to provide a simple mechanism that retracts the feed dog, that enables sufficient tightening of the upper thread loop so that resultant stitches are attractive, and that prevents dust and dirt from clinging to the feed dog while the feed dog is in its retraction position.

According to the present invention, configuration is provided for driving the feed dog to move vertically while maintaining the feed dog below the level of the upper surface of the needle case. More specifically, a sewing machine according to the present invention includes a needle bar, a needle plate, a loop taker, an upper thread take-up lever, a feed dog, a feed dog retraction mechanism, and a feed dog vertical drive unit.

The needle bar is attached with a sewing needle for supporting an upper thread. The loop taker is disposed below the needle plate and supports a lower thread. The loop taker operates cooperatively with the needle bar forming to form stitches with the upper and lower threads.

The upper thread take-up lever tightens the upper thread when a stitch is formed and the feed dog is disposed above the loop taker.

The feed dog retraction mechanism switches the feed dog into a retracted condition, wherein the feed dog is retracted below a level of the upper surface of the needle plate.

The feed dog vertical drive unit drives vertical movement of the feed dog. The feed dog vertical drive unit has a retracted feed dog drive unit that drives the feed dog to move vertically while in the retracted condition into which the feed dog is switched by the feed dog retraction mechanism. The retracted feed dog drive unit drives the feed dog to move upward when the upper thread is tightened by the upper thread take-up lever.

Because the feed dog is moved upward when the upper thread is tightened by the upper thread take-up lever, sufficient space can be secured between the feed dog and a loop taker, so that the upper thread loop can be sufficiently tightened to produce an attractive stitch. Further, because the feed dog is maintained below the level of the upper surface of the needle case, dust and another foreign matter can not easily cling to the feed dog.

It is desirable that the present invention be applied to a sewing machine with a mechanism for driving movement of an embroidery frame. In this case, because the retracted feed dog drive unit drives the feed dog maintained below the level of the upper surface of the needle case, the feed dog will not interfere with movement of a workpiece cloth supported in the embroidery frame.

It is desirable that the vertical stroke of the feed dog be shorter while the feed dog is its retracted condition than during normal sewing. With this configuration, vibration and noise caused by a vertical movement of the feed dog is reduced and also power consumption is reduced.

It is desirable that the feed dog move upward when a thread take up lever is its uppermost position. With this configuration, when the upper thread loop is being tightened to form a stitch, a space between the feed dog and the loop taker will be enlarged to its maximum size so that friction between the feed dog, the upper thread, the lower thread, and the loop taker will be reduced to a minimum. As a result, the upper thread can be properly tightened so that attractive stitches can be formed.

It is desirable that the feed dog be lowered when the thread take up lever is at its lower position. If feed dog is lowered when the thread take-up lever is being raised or in its upper position, then resistance between the threads and the feed dog would prevent the upper thread from being properly tightened.

It is desirable that vertical movement of the feed dog be controlled by two cams, a vertical drive cam for driving the feed dog to move reciprocally above and below the level of the thread plate, and a retraction drive cam for driving the feed dog to vertically move while maintained below the level of the needle plate. It is further desirable that the two cams be formed integrally together. With this configuration, when normal sewing, for example, for sewing practical stitches is being performed, the workpiece cloth is fed using the vertical drive cam. When embroidery sewing is being performed for sewing embroidery patterns, the retraction drive can drive the feed dog to move vertically while the feed dog is maintained in its retracted condition. Because the vertical drive cam and the retraction drive cam are formed integrally together into a single component, the cam can be easily manufactured.

According to another aspect of the present invention, a sewing machine includes a needle plate with an upper surface; a feed dog for transporting a workpiece cloth supported on the needle plate; and a feed dog vertical drive unit for driving vertical movement of the feed dog.

The feed dog vertical drive unit includes a normal sewing feed dog drive member and a retracted feed dog drive member. The normal sewing feed dog drive member controls vertical movement of the feed dog between a position below a level of the upper surface of the needle plate and a position above the level of the needle plate. The retracted feed dog drive member controls vertical movement of the feed dog between vertically different positions while maintaining the feed dog retracted below the level of the upper surface of the needle plate.

According to still another aspect of the present invention, a sewing machine includes a needle plate, a feed dog, a feed dog retraction mechanism, and a feed dog vertical drive unit.

The feed dog retraction mechanism switches the feed dog into a retracted condition wherein the feed dog is retracted below a level of the upper surface of the needle plate.

The feed dog vertical drive unit drives vertical movement of the feed dog. The feed dog vertical drive unit has a retracted feed dog drive unit that drives the feed dog to move vertically while in the retracted condition into which the feed dog is switched by the feed dog retraction mechanism. The retracted feed dog drive unit drives the feed dog to move upward when an upper thread is being pulled taught.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
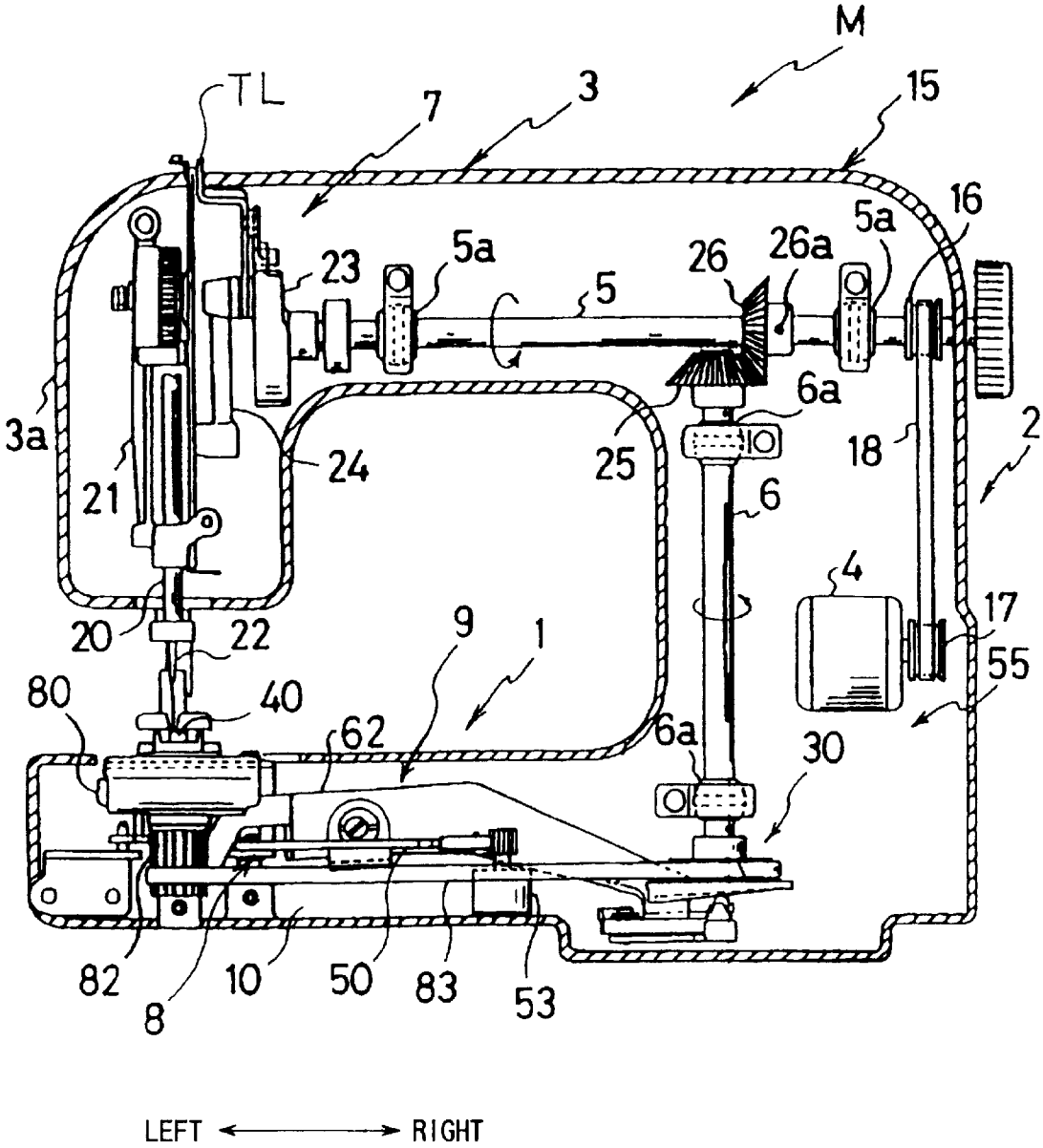
FIG. 1 is a cross-sectional view showing a sewing machine according to an embodiment of the present invention.

A sewing machine M according to an embodiment of the present invention will be described while referring to the accompanying drawings wherein like parts and components are designated by the same reference numerals to avoid duplicating description.

Figure 11:
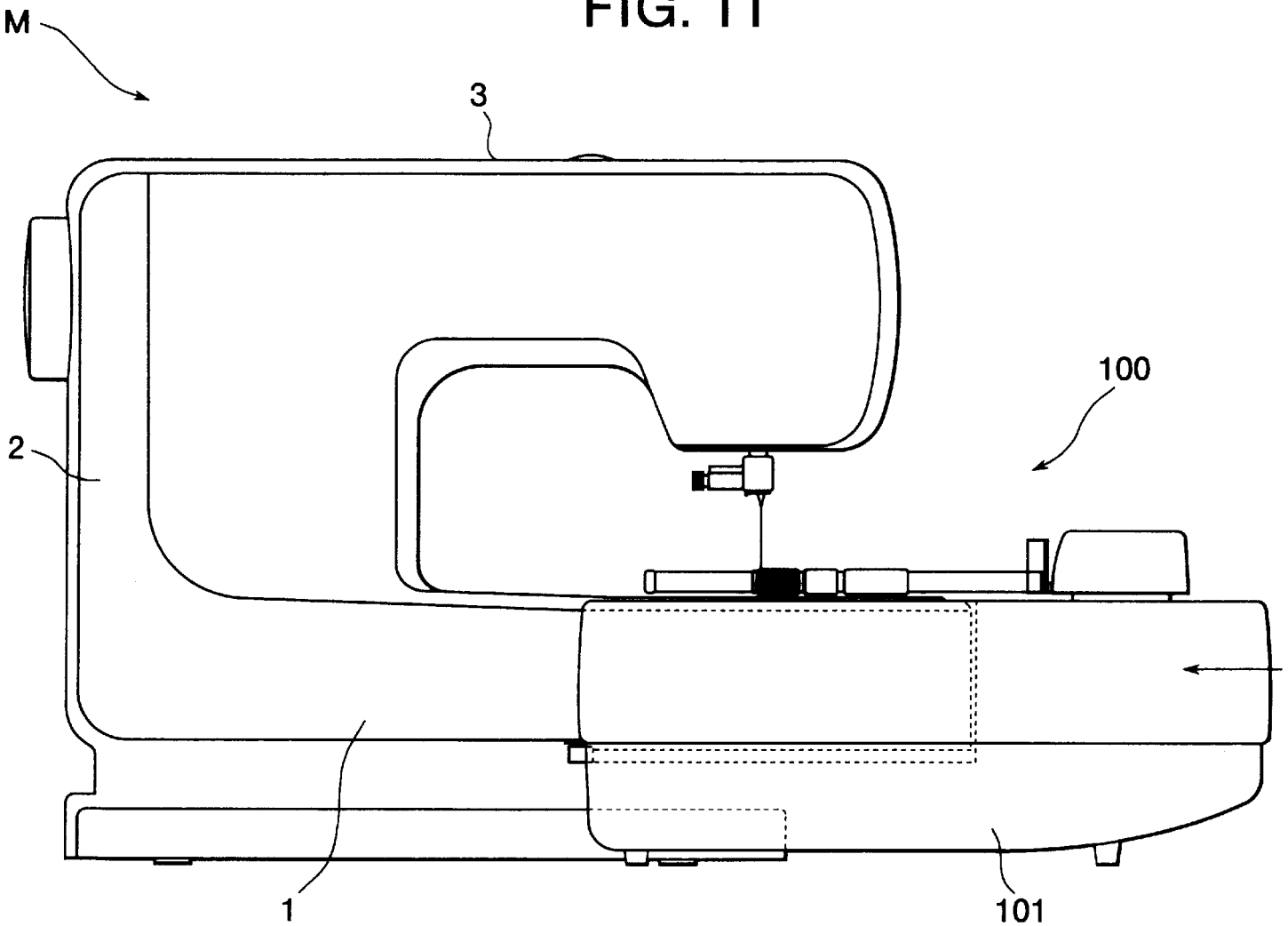
FIG. 11 is a side view showing the sewing machine of FIG. 1 mounted with an embroidery frame movement mechanism.

The electrically controlled sewing machine M according to the embodiment is capable of sewing embroidery patterns as well as practical stitches. As shown in FIG. 1, the sewing machine M includes a bed portion 1, a column portion 2, an arm portion 3, and a head portion 3*a*. The column portion 2 is connected in an upright posture to the right end of the bed portion 1. The arm portion 3 extends leftward from the upper end of the column portion 2, above and in confrontation with the bed portion 1. The head portion 3*a* is disposed at the left tip of the arm portion 3. As shown in FIG. 11, an embroidery frame movement mechanism 101 can be attached onto the bed portion 1. The embroidery frame movement mechanism 101 is for transporting an embroidery frame (not shown) with respect to a sewing needle 22, so that embroidery patterns can be formed in a work piece cloth mounted in the embroidery frame.

Figure 6:
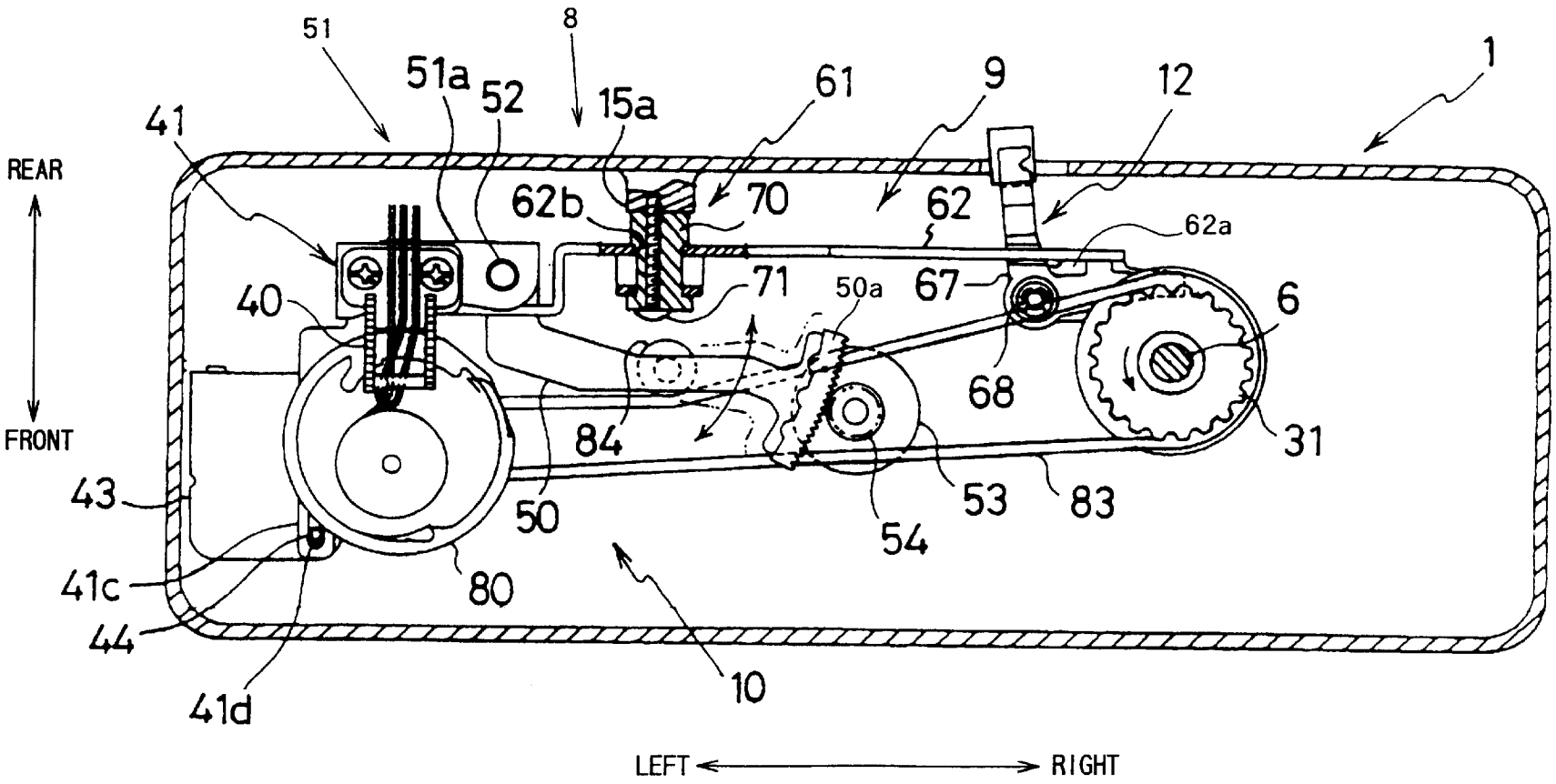
FIG. 6 is a cross-sectional view of the bed portion taken as viewed from above.

The sewing machine M has a dye cast frame 15 that houses internally a sewing machine motor 4; a principle shaft 5 driven to rotate by the sewing machine motor 4; a drive shaft 6 interlockingly connected with the principle shaft 5; a needle bar vertical movement mechanism 7 for driving vertical movement of a needle bar 20; a feed dog front/rear drive mechanism 8 for driving forward and rearward movement of a feed dog 40, which is provided near the left end of the bed portion 1; a feed dog vertical drive mechanism 9 for driving vertical movement of the feed dog 40; a loop taker drive mechanism 10 for driving rotation of a vertical axis oscillating shuttle 80. As shown in FIG. 6, a feed dog retraction mechanism 12 for switching the feed dog 40 into a retracted condition is also housed in the dye cast frame 15.

Returning to FIG. 1, the principle shaft 5 extends leftward and rightward in the arm portion 3. The principle shaft 5 is freely rotatably supported by a pair of ball bearings 5*a* that are attached to dye cast frame 15. A timing pulley 16 is fixed to the right end of the principle shaft 5 and a timing pulley 17 is fixed to the output shaft of the sewing machine motor 4. A timing belt 18 is mounted on the timing pulleys 16 and 17 so that drive of the sewing machine motor 4 drives the principle shaft 5 to rotate in a predetermined direction. An upper thread take-up lever TL for drawing the upper thread upward to tighten stitches is provided in the arm portion 3.

A needle bar support body 21 is supported at its upper end on the frame 15. The needle bar support body 21 is provided so as to swingable leftward and rightward within the head portion 3*a*. The needle bar 20 is supported by the needle bar support body 21 so as to be vertically movable. The sewing needle 22 is attached to the lower end of the needle bar 20. The needle bar vertical movement mechanism 7 and the loop taker drive mechanism 10 are operated in synchronization to drive the sewing needle 22 and the vertical axis oscillating shuttle 80 in synchronization to form stitches in a workpiece cloth supported on the upper surface of the bed.

Figure 5:
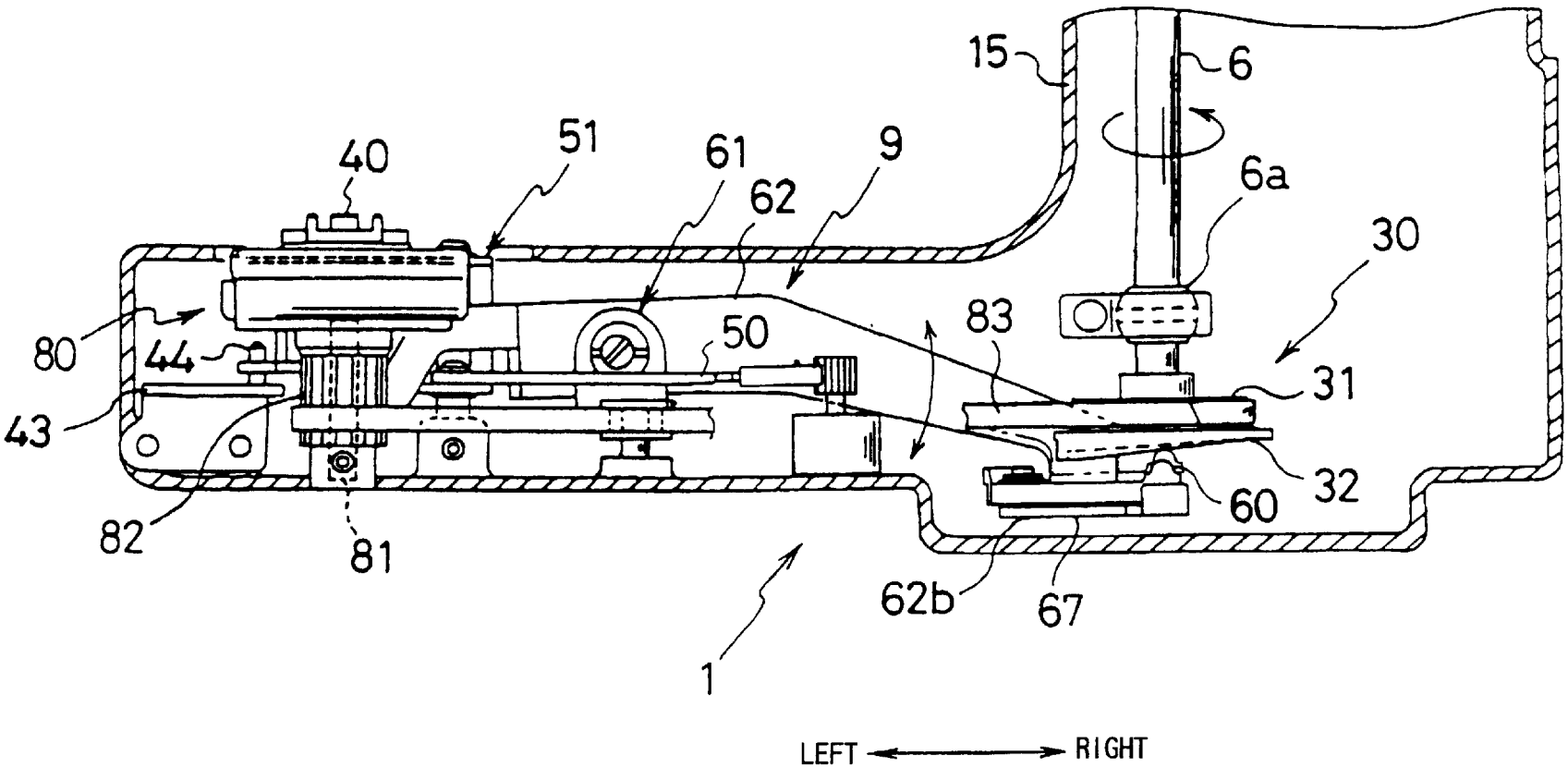
FIG. 5 is a partial cross-sectional view similar to FIG. 4, but further showing a vertical axis oscillating shuttle in the bed portion.

The vertical axis oscillating shuttle 80 is for forming a thread loop from the upper thread in synchronization with movement of the sewing needle 22 attached to the needle bar 20. As shown in FIG. 5, the vertical axis oscillating shuttle 80 is provided below the feed dog 40. The lower end of a vertically extending shaft 81 is fixed to the frame 15 near the left end of the bed portion 1. The vertical axis oscillating shuttle 80 is supported on the shaft 81 so as to be freely rotatable around an imaginary vertical axis of the shaft 81.

Here, an explanation will be provided for the needle bar vertical movement mechanism 7. A crank member 23 is fixed to the left end of the principle shaft 5. A crank lever 24 is connected at its upper end to the crank member 23 by a pin and at its lower end to near the center of the needle bar 20. With this configuration, when the sewing machine motor 4 drives the principle shaft 5 to rotate, the needle bar 20 is driven to move vertically via the crank member 23 and the crank lever 24.

The drive shaft 6 is freely rotatably supported in an upright posture within the column portion 2 by a pair of ball bearings 6*a* attached to the frame 15. A bevel gear 25 is attached to the upper end of the drive shaft 6. A bevel gear 26 in meshing engagement with the bevel gear 25 is fitted around the principle shaft 5. The meshing engagement between the pair of bevel gears 25, 26 interlocks rotation of the drive shaft 6 and the principle shaft 5. It should be noted that the bevel gear 26 is fixed onto the principle shaft 5 by a screw 26*a*.

Figure 2:
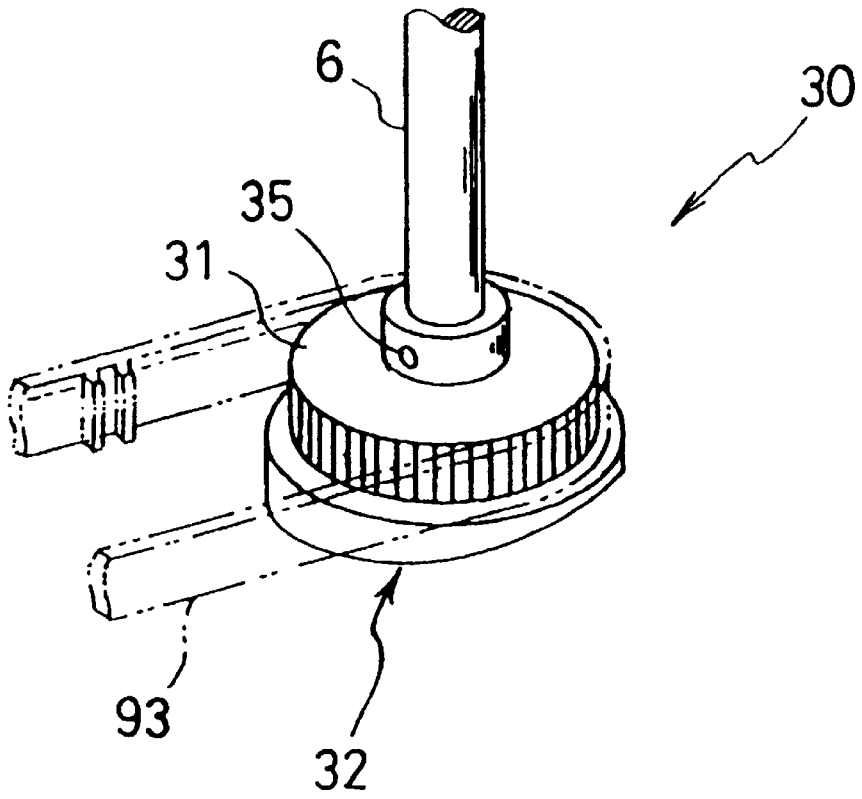
FIG. 2 is a partial perspective view showing a cam body, in particular, the integral timing pulley and feed dog vertical drive cam of the cam body.

Here, a cam body 30 fixed to the lower end of the drive shaft 6 will be described while referring to FIGS. 2 and 3. The cam body is formed from a synthetic resin material. A through hole 30*a* is formed vertically through the center of the cam body 30. The lower end of the drive shaft 6 is fitted into the through hole 30*a* and fixed in place by a pin 35 to prevent rotation between the cam body 30 and the drive shaft 6. In this way, the cam body 30 is axially centered on the drive shaft 6.

The cam body 30 includes an integrally formed timing pulley 31 and feed dog vertical drive cam 32, wherein the feed dog vertical drive cam 32 is disposed below the timing pulley 31. The outer peripheral diameter of the feed dog vertical drive cam 32 is larger than the diameter of the timing pulley 31. Therefore, the timing belt 93 wrapped on the timing pulley 31 is supported on the upper side edge of the feed dog vertical drive cam 32. The timing pulley 31 is for driving rotation, via the timing belt 93, of the vertical axis oscillating shuttle 80 in order to rotate the vertical axis oscillating shuttle 80 around its imaginary vertical axis. The feed dog vertical drive cam 32 is for driving vertical movement of the feed dog 40.

Figure 3:
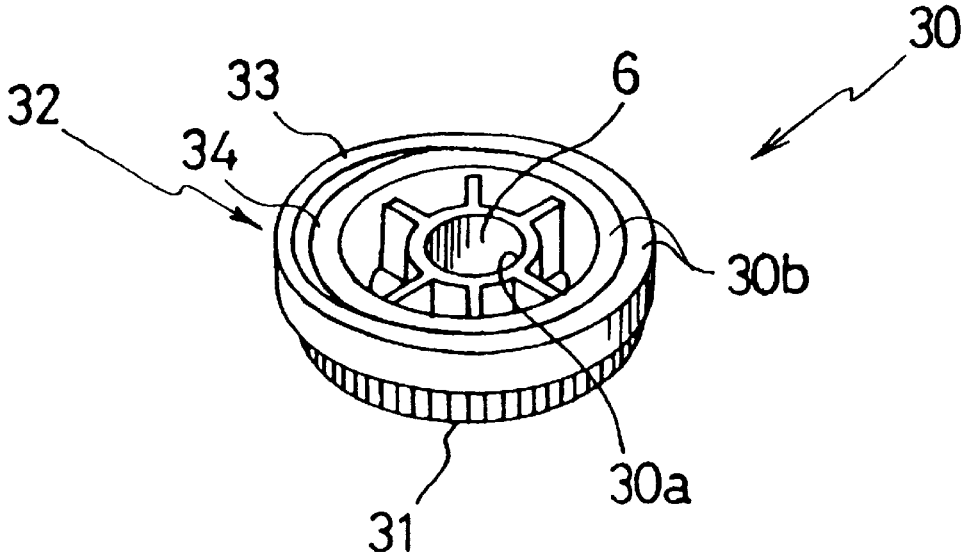
FIG. 3 is a perspective view showing the underside of the cam body, in particular, the vertical drive cam and an integral retraction drive cam of the cam body.
Figure 4:
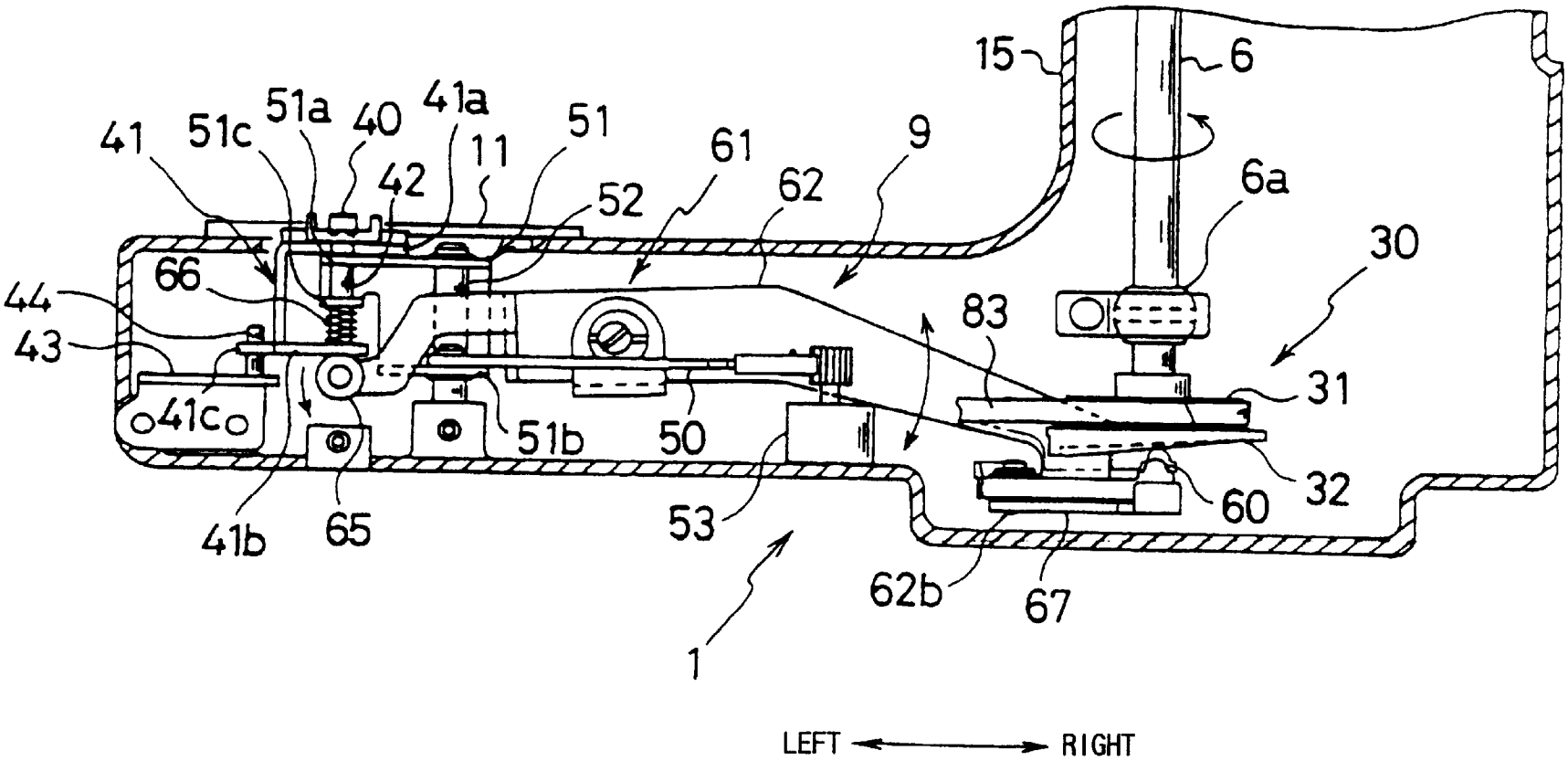
FIG. 4 is a partial cross-sectional view showing internal configuration of a bed portion of the sewing machine.

As shown in FIG. 3, the feed dog vertical drive cam 32 is formed at its lower surface with an integral vertical drive cam 33 and retraction drive cam 34. The vertical drive cam 33 is formed on the outer peripheral portion of the lower surface and the retraction drive cam 34 is formed to the direct interior of the vertical drive cam 33. The vertical drive cam 33 and the retraction drive cam 34 are concentric with each other, both being centered on the imaginary axial center of the drive shaft 6. The drive cams 33, 34 are formed with connection portions 30*b* that are coplanar with each other, that is, which have the same height, to facilitate switching between the drive cams 33, 34 in a manner to be described later. The vertical drive cam 33 is used during normal sewing and the retraction drive cam 34 is used for driving vertical movement of the feed dog 40 while the feed dog 40 is maintained in the retracted condition below the upper surface of a needle plate 11.

Next, an explanation will be provided for the feed dog front/rear drive mechanism 8, the feed dog vertical drive mechanism 9, and the loop taker drive mechanism 10. As shown in FIGS. 4 to 7, a feed frame 41 having a substantially C shape is disposed under the needle plate 11. The feed frame 41 has a pair of horizontal support plates 41*a*, 41*b* in a vertical two layer condition. The feed dog 40 is attached to the upper horizontal support plate 41*a* of the feed frame 41.

An extending portion 41*c* extends forward from the lower support plate 41*b*. An elongated hole 41*d* is formed in the front end of the extended portion 41*c*. A support plate 43 is attached to the frame 15 in horizontal alignment with the support plates 41*a*, 41*b*. An engagement pin 44 protrudes upward from the support plate 43, through the elongated hole 41*d*. A horizontal pin 42 is inserted through holes in the pair of support plates 41*a*, 41*b*, and so is freely movable in the vertical direction.

A swing member 51 is formed in a substantially reverse C shape as viewed from the left or right side, and includes a pair of horizontal upper and lower swing plates 51*a*, 51*b* arranged in a two-layer condition, and a horizontal plate 51*c*. The right end of both swing plates 51*a*, 51*b* is supported on a vertical shaft 52, which is fixed to the frame 15. The horizontal plate 51*c* protrudes outward in confrontation with the lower left end of the swing plate 51*a*. The horizontal pin 42 passes through the horizontal plate 51*c* and the left end of the swing plate 51*a*. The center portion of the horizontal pin 42 is fixed to the left end of a swing member 51.

With this configuration, swinging movement of the swing member 51 drives the feed frame 41 to move reciprocally forward and backward as guided by the elongated hole 41*d*. In other words, the elongated hole 41*d* prevents the feed stand 41 from pivoting with swinging movement of the swing member 51.

As shown in FIG. 6, the feed dog front/rear drive mechanism 8 includes the swing member 51, a front/rear movement link 50 connected integrally with the swing member 51, and a front/rear drive motor 53 for swinging the front/rear movement link 50. The front/rear movement link 50 is formed at its front tip with a gear portion 50*a*. A drive gear 54 fixed to the drive shaft of the front/rear drive motor 53 is meshingly engaged with the gear portion 50*a*. The front/rear drive motor 53 is provided adjacent to the front/rear movement link 50.

During normal sewing, the front/rear drive motor 53 is driven to rotate counterclockwise as viewed in FIG. 6, by an amount corresponding to the amount that the workpiece cloth is to be transported by the feed dog 40. When the front/rear drive motor 53 rotates, the front/rear movement link 50 and the swing member 51 pivot clockwise around the vertical shaft 52. As a result, the feed dog 40 is driven to move backwards. At this time the feed dog 40 is raised up about 1 mm higher than the needle plate 11 by operation of the feed dog vertical drive mechanism 9. Then, the front/rear drive motor 53 is rotated clockwise as viewed in FIG. 6, so that the front/rear movement link 50 and the swing member 51 pivot counterclockwise so that the feed dog 40 is driven forward. At this time, the feed dog 40 is lowered to a position about 1 mm lower than the needle plate 11.

Figure 7:
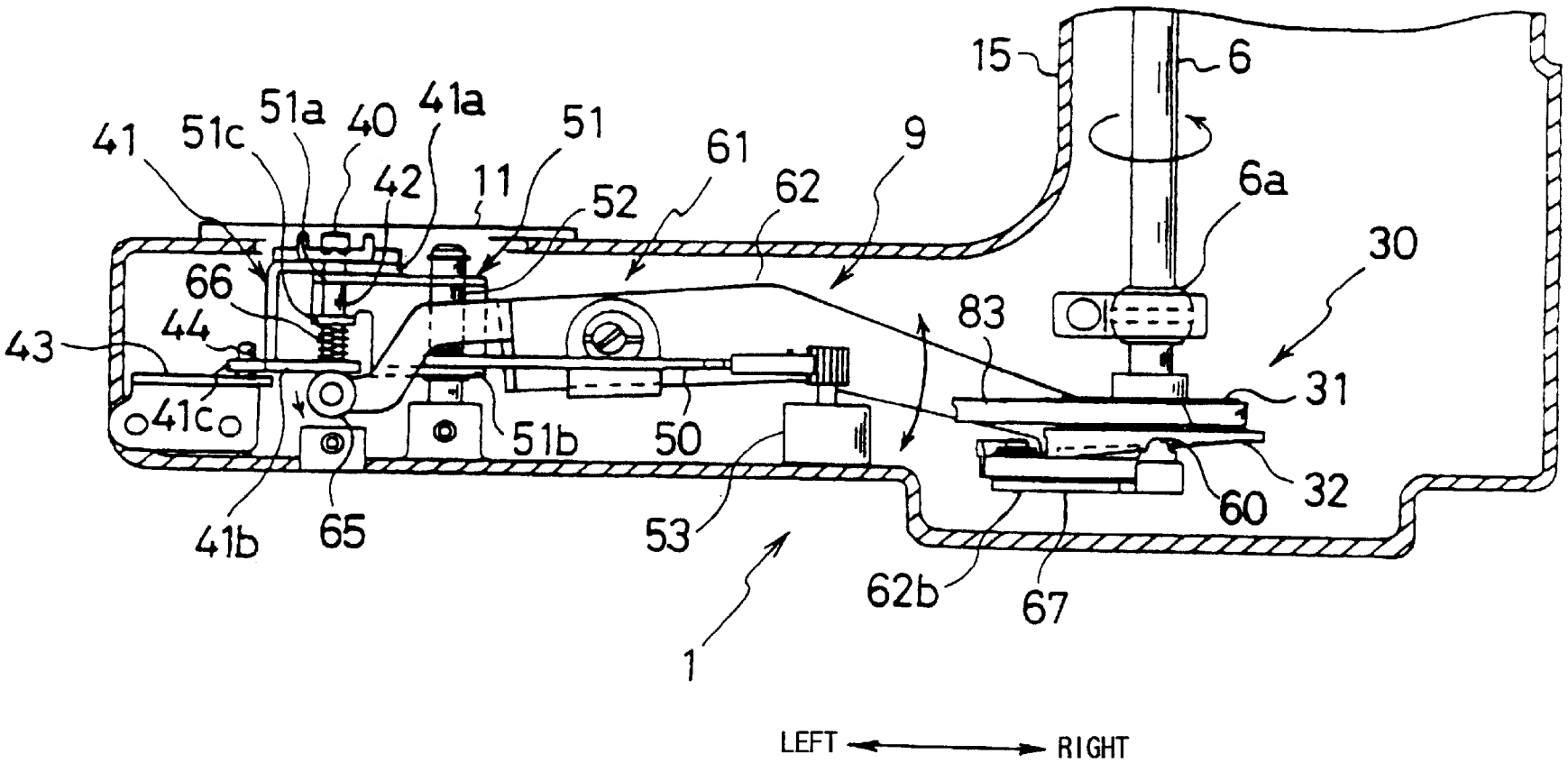
FIG. 7 is the partial cross-sectional view of FIG. 4, wherein a feed dog is in a retracted condition.

As shown in FIG. 7, the feed dog vertical drive mechanism 9 includes the drive shaft 6, the cam body 30, a follower rib 60, and a vertical drive link 62. The follower rib 60 is supported on a switching operation lever 67. As will be described later, the switching operation lever 67 can be operated to selectively abut the follower rib 60 against the vertical drive cam 33 or the retraction drive cam 34.

The vertical drive link 62 extends substantially horizontally leftward and rightward near the rear end of the bed portion 1, but has a slightly angled downward sloping shape as viewed in FIG. 7. The vertical drive link 62 is pivotably supported on the frame 15 by an eccentric support mechanism 61. Here, a brief explanation will be provided for the eccentric support mechanism 61 while referring to FIGS. 6 and 7. A support hole 62*b* is formed in the vertical drive link 62 at a position along the length of the vertical drive link 62. A cylindrical stepped collar 70 is rotatably fitted in the support hole 62*b*. The stepped collar 70 is fixed to a bossed portion 15*a* of the frame 15 by a set screw 71. The set screw 71 is screwingly engaged in the stepped collar 70 at a position eccentric from the axial center of the stepped collar 70. By loosening the set screw 71 and pivoting the stepped collar 70, the axial center of the vertical drive link 62 becomes eccentric so that the height of the vertical movement range of the feed dog 40 can be adjusted.

Figure 8:
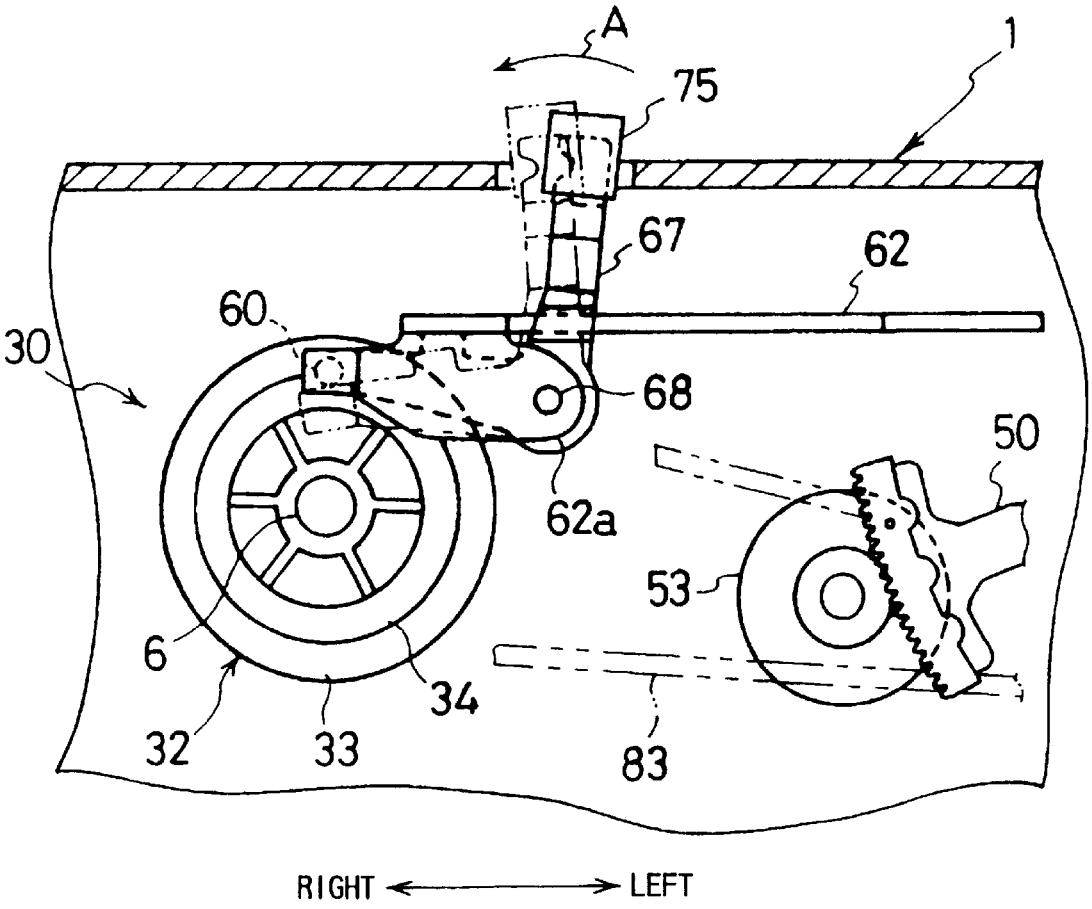
FIG. 8 is a partial cross-sectional view showing an operation grip and related configuration for switching the sewing machine between a normal sewing mode and an embroidery mode.

Next, configuration at and near the right end of the vertical drive link 62 will be described. As shown in FIG. 8, a substantially L-shaped, that is, in plan view, follower rib support portion 62*a* is formed at the right tip of the vertical drive link 62. The follower rib support portion 62*a* is formed with a bend at its front end that extends in a substantially horizontal posture. As shown in FIG. 6, the base of the switching operation lever 67 is pivotably supported on the horizontal bent portion of the follower rib support portion 62*a* by a pin 68. As shown in FIG. 8, the follower rib 60 is fixed with an upright posture to one end of the switching operation lever 67. The follower rib 60 is constantly pressed into abutment with the lower surface of the vertical drive cam 33, by urging force of the compression coil spring 66 that urges the vertical drive link 62 to pivot.

Next, configuration near the left end of the vertical drive link 62 will be described. As shown in FIG. 7, a roller 65 is rotatably connected to the left end of the vertical drive link 62. The roller 65 is disposed in abutment with the lower surface of the support plate 41*b* of the feed frame 41. A compression coil spring 66, which urges the feed frame 41 to constantly press against the roller 65, is wound around the outside of the horizontal pin 42, between the support plate 41*b* and the extending portion 41*c* of the swing member 51.

With this configuration, when rotation of the drive shaft 6 simultaneously rotates the vertical drive cam 32, the follower rib 60 follows the cam surfaces 33, 34 of the vertical drive cam 32 and moves vertically accordingly against the urging force of the spring 66. The vertical drive link 62 pivots in accordance with vertical movement of the follower rib 60, so that the roller 65 also moves vertically. The feed dog 40 follows vertical movement of the roller 65 and so is driven to move vertically by the roller 65.

Figure 9:
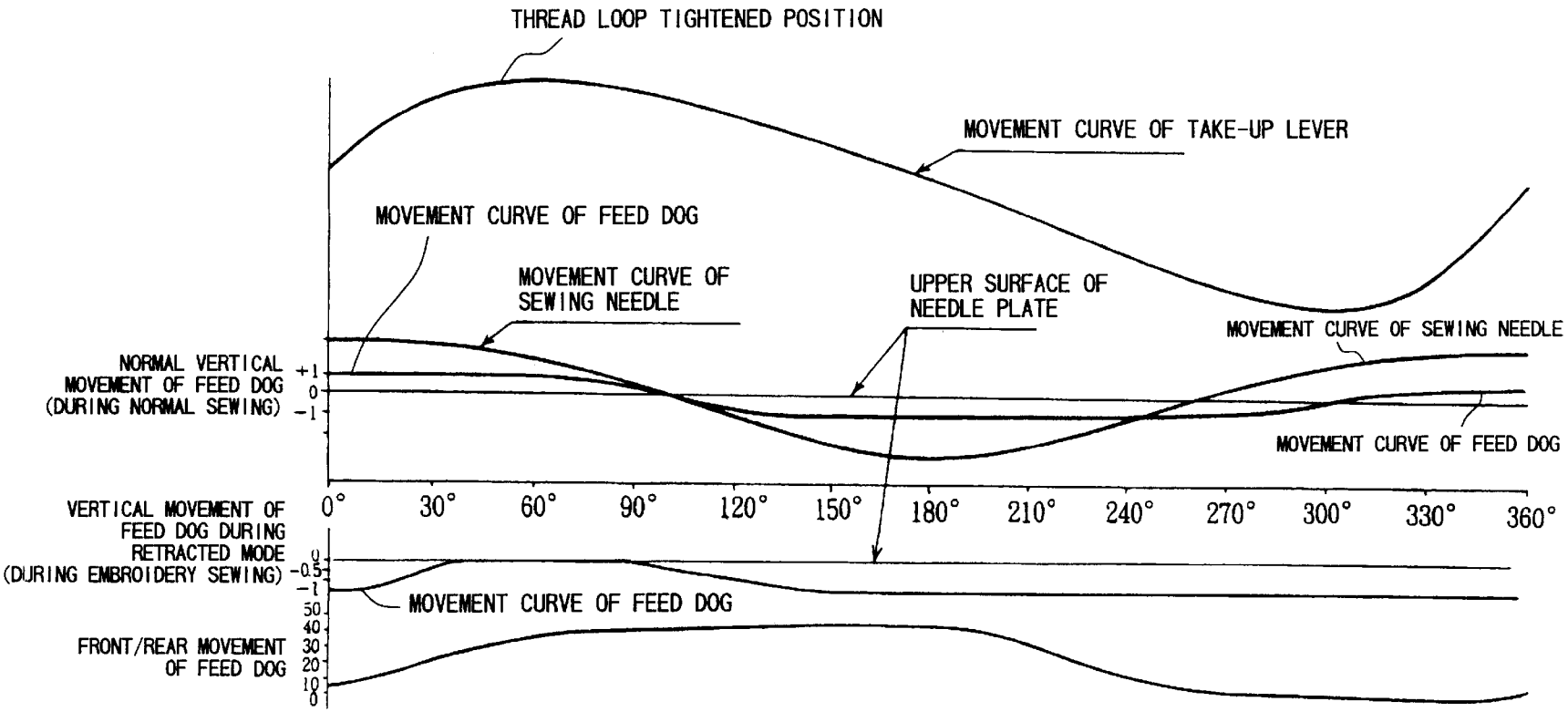
FIG. 9 is a timing chart showing relative positions of various components of the sewing machine during normal sewing and embroidery modes.

FIG. 9 is a chart representing relative positions of the thread take-up lever, the sewing needle 22, the feed dog 40, and the upper surface of the needle plate 11 based on phase of the needle bar 20, wherein 0° phase is the upper dead point of the needle bar 20. As shown in FIG. 8 and as described previously, the switching operation lever 67 is freely pivotably supported on the follower rib support portion 62*a* of the vertical drive link 62. The follower rib 60 is fixed to one end of the switching operation lever 67 and an operation grip 75 is attached to the other end of the switching operation lever 67.

During normal sewing, such as when practical patterns are being sewn, the operation grip 75 of the switching operation lever 67 is disposed in the orientation indicated by solid line in FIG. 8. In this condition, the follower rib 60 is supported in abutment with the vertical drive cam 33. In this condition, when the vertical drive cam 33 is rotated by rotation of the drive shaft 6, the resultant pivoting movement of the vertical drive link 62 moves the feed dog 40 to its uppermost position about 1 mm above the upper surface of the needle plate 11 between an approximately 310° and 100° phase range. On the other hand, the feed dog 40 is moved below the upper surface of the needle plate 11 by about 1 mm as shown in FIG. 7, during the phase range of about 100° to 310°. The feed dog 40 is driven to move forward while in its uppermost position and driven to move in reverse when it is in its lowermost position, thereby moving in a predetermined four-movement feed pattern.

While the follower rib 60 is disposed in opposition with the connection portion 30*b*, wherein the feed dog 40 is in the lowermost position as shown in FIG. 7, the operation grip 75 can be moved in the direction indicated by an arrow A in FIG. 8, so that the operation lever 67 moves from the position for normal sewing indicated by a solid line in FIG. 8 into the retraction position indicated by a two-dot chain line in FIG. 8. As a result, the follower rib 60 will move from in confrontation with the vertical drive cam 33 to in confrontation with the retraction drive cam 34. The coplanar connection portions 30*b* facilitate movement of the follower rib 60 from the vertical drive cam 33 to the retraction drive cam 34.

While the switching operation lever 67 is in the retraction position shown by the two-dot chain line in FIG. 8, the follower rib 60 will follow the cam surface of the retraction drive cam 34 when the drive shaft 6 rotates and the retraction drive cam 34 rotates simultaneously with the drive shaft 6. When the follower rib 60 follows the cam surface of the retraction drive cam 34, then during the phase range from about 40° to 90° as shown in FIG. 9, the feed dog 40 moves from a retracted position below the upper surface of the needle plate 11 upward to substantially level with the upper surface of the needle plate 11 in a small stroke. That is, the vertical stroke of the feed dog 40 is shorter during a retraction mode, that is, during embroidery sewing, than during normal sewing. Also, during the retraction mode, the feed dog 40 rises upward when the thread take up lever is near the end of its upward movement, that is, when the thread loop is tightened, and feed dog 40 moves downward at about the same time as when the thread take up lever starts moving downward.

Next, the loop taker drive mechanism 10 will be described while referring to FIGS. 5 and 6. A timing pulley 82 is formed integrally to the lower end of the vertical axis oscillating shuttle 80. A timing belt 83 is suspended between the timing pulley 82 and the timing pulley 31 of the cam body 30. With this configuration, rotation of the drive shaft 6 and consequential rotation of the cam body 30 drive the vertical axis oscillating shuttle 80 to rotate via the timing pulleys 31, 82 and the timing belt 83. The diameter of the timing pulleys 31, 82 are different so that the vertical axis oscillating shuttle 80 is driven to rotate twice the rotational speed of the drive shaft 6 to cooperate with the sewing needle 22 to form stitches in the workpiece cloth. A tension pulley 84 shown in FIG. 6 is provided for applying a predetermined tension to the timing belt 83.

The rotational phase of the drive shaft 6 can be minutely adjusted with respect to the rotational phase of the principle shaft 5 by loosening the screw 26*a* of the bevel gear 26 and rotating the drive shaft 6 without rotating the principle shaft 5. In this way, a timing of when the sewing needle 22 and the loop taker beak of the loop taker 80 meet each other can be minutely adjusted while maintaining rotational phase of the loop taker 80, the vertical movement of the feed dog 40, and the front/rear movement drive timing in a predetermined positional relationship.

Next, effects and operations of the electrically controlled sewing machine will be described. When the sewing machine motor 4 is driven, the needle bar 20 is driven to move vertically via the principle shaft 5 and the needle bar vertical movement mechanism 7. At this time, the cam body 30 is driven to rotate by rotation of the drive shaft 6. During normal sewing, when the switching operation lever 67 is switched to the normal position indicated by the solid line of FIG. 8, the follower rib 60 is in confrontation with the vertical drive cam 33, and so is driven by rotation of the cam body 30 to move vertically according to the surface contour of the vertical drive cam 33. In this case, as shown in FIG. 9, the feed dog 40 is moved to a level higher than the upper surface of the needle plate 11 between the phase range of 310° to 100° and is moved to a level lower than the upper surface of the needle plate 11 during the phase period of about 100° to 310°. Consequently, the feed dog front/rear drive mechanism drive the feed dog 40 forward and rearward in a four step feed movement to transport the workpiece cloth.

On the other hand, during embroidery sewing, when the switching operation lever 67 is switched to the retraction position indicated by the two-dot chain line in FIG. 8, then the follower rib 60 will be in abutment with the retraction drive cam 34. This switches the feed dog 40 into its retracted condition, wherein when the thread take up lever is at the end of its upward movement wherein the thread loop is being tightened, that is, at a phase position between about 40° to 90°, the feed dog 40 rises upward from the retraction position by a small stroke to a height approximately level with the upper surface of the needle plate 11. Because the stroke amount during embroidery sewing is shorter than the vertical stroke during normal sawing, vibration and noise caused by vertical drive of the feed dog 40 can be reduced. Also, consumption of power can be reduced.

Figure 10:
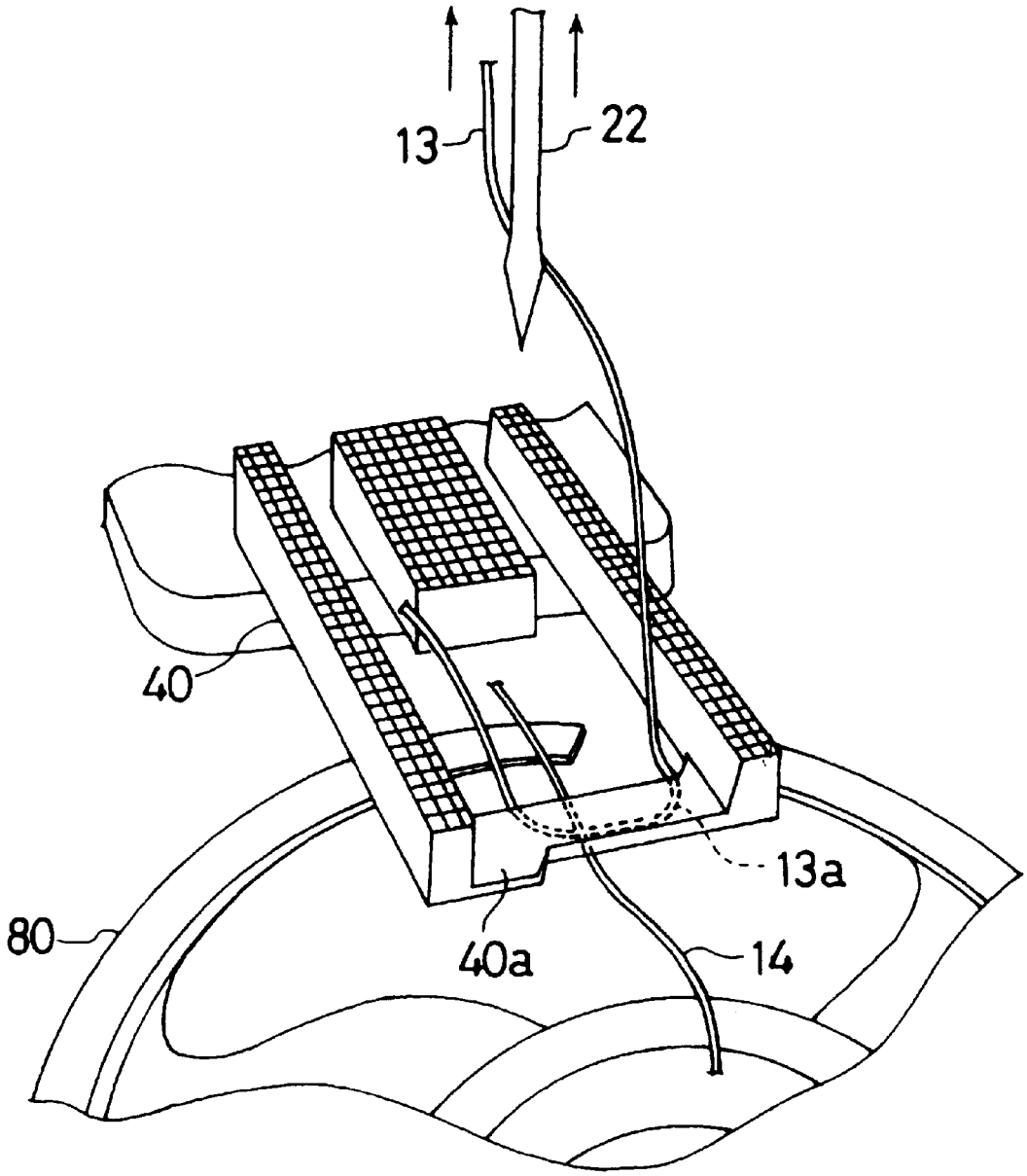
FIG. 10 is a schematic view showing relationship between a feed dog, a loop taker, and upper and lower threads when the upper thread is being tightened.

FIG. 10 shows the positional relationship of the feed dog 40 and the loop taker 80 when the thread take up lever is raised to its uppermost position to complete tightening of the upper thread loop 13*a*, that is, after the upper thread loop 13*a* of the upper thread 13 after the loop 13*a* has been expanded by the loop taker beak of the vertical axis oscillating shuttle 80 and the lower thread 14 has been threaded through the loop. At this time, the feed dog 40 is separated from the loop taker 80 to a position substantially level with the upper surface of the needle plate 11. Therefore, the upper thread loop 13*a* threaded with the lower thread 14 can properly pass by the connection portion 40*a* at the end of the feed dog 40. Also, the feed dog 40 is raised up about 1 mm from its lowermost retracted condition while the upper thread is being drawn upwards by the thread take-up lever. Because the feed dog 40 and the upper thread move upward together, resistance between the connection portion 40*a* and the upper thread loop 13*a* is reduced. Therefore, the lower thread 14 and the upper thread loop 13*a* can easily pass through the space with no resistance. Because the thread tension is maintained at a proper level, the resultant stitches will be attractive. Afterward, the feed dog 40 moves downward again at about the same time as the thread take up lever starts to move downward.

Because the feed dog 40 moves vertically in a retracted condition, dust and other foreign matter can not easily cling to the feed dog 40. Also, because the vertical drive cam 33 and the retraction drive cam 34 are formed into an integral single component, the cam body 30 which includes both of these cams is simple to manufacture.

While the invention has been described in detail with reference to specific embodiments thereof, it would be apparent to those skilled in the art that various changes and modifications may be made therein without departing from the spirit of the invention, the scope of which is defined by the attached claims.

For example, the feed dog front/rear drive mechanism 8, the feed dog vertical drive mechanism 9, and the feed dog retraction mechanism 12 described in the embodiment are mere examples and can be replaced by variety of similarly functioning mechanisms. For example, the connection portion 40*a* and the parrallelly aligned cloth-moving members of the feed dog need not be integrally formed together. The connection portion 40*a* could be connected directly to the base that supports the cloth moving members. Also, the present invention can be applied to an electrically controlled sewing machine mounted with an integral embroidery device.

What is claimed is:

1. A sewing machine comprising:

a needle bar attached with a sewing needle for supporting an upper thread;

a needle plate with an upper surface;

a loop taker disposed below the needle plate and for supporting a lower thread, the loop taker operating cooperatively with the needle bar forming to form stitches with the upper and lower threads;

an upper thread take-up lever that tightens the upper thread when a stitch is formed;

a feed dog disposed above the loop taker;

a feed dog retraction mechanism that switches the feed dog into a retracted condition wherein the feed dog is retracted below a level of the upper surface of the needle plate; and a feed dog vertical drive unit that drives vertical movement of the feed dog, the feed dog vertical drive unit having a retracted feed dog drive unit that drives the feed dog to move vertically while in the retracted condition into which the feed dog is switched by the feed dog retraction mechanism, the retracted feed dog drive unit driving the feed dog to move upward when the upper thread is tightened by the upper thread take-up lever.

2. A sewing machine as claimed in claim 1, further comprising:

a bed portion housing the loop taker; and an embroidery frame drive unit detachably mounted on the bed portion.

3. A sewing machine as claimed in claim 1, wherein the feed dog vertical drive unit drives vertical movement of the feed dog in a shorter vertical stroke using the retracted feed dog drive unit than during normal sewing.

4. A sewing machine as claimed in claim 1, wherein the thread take-up lever moves vertically up and down, the retracted feed dog drive unit driving the feed dog to move upward with a portion of upward movement of the thread take-up lever.

5. A sewing machine as claimed in claim 1, wherein the thread take-up lever moves vertically up and down, the retracted feed dog drive unit driving the feed dog to move downward with a portion of downward movement of the thread take-up lever.

6. A sewing machine as claimed in claim 1, wherein:

the feed dog vertical drive mechanism has a vertical drive cam that is driven to rotate; and the retracted feed dog drive unit has a retraction drive cam formed integrally with the vertical drive cam.

7. A sewing machine as claimed in claim 1, wherein the loop taker is a vertical axis oscillating shuttle.

8. A sewing machine comprising:

a needle plate with an upper surface;

a feed dog for transporting a workpiece cloth supported on the needle plate;

a feed dog vertical drive unit for driving vertical movement of the feed dog, the feed dog vertical drive unit including:

a normal sewing feed dog drive member that controls vertical movement of the feed dog between a position below a level of the upper surface of the needle plate and a position above the level of the needle plate, and a retracted feed dog drive member that controls vertical movement of the feed dog between vertically different positions while maintaining the feed dog retracted below the level of the upper surface of the needle plate.

9. A sewing machine as claimed in claim 8, wherein the feed dog vertical drive unit further includes a switching mechanism for selecting use of one of the normal sewing feed dog drive member and the retracted feed dog drive member, in order to control vertical movement of the feed dog.

10. A sewing machine as claimed in claim 8, further comprising:

a bed portion including the needle plate; and an embroidery frame drive unit detachably mounted on the bed portion.

11. A sewing machine as claimed in claim 8, wherein the retracted feed dog drive member regulates vertical movement of the feed dog to a shorter vertical stroke than does the normal sewing feed dog drive member.

12. A sewing machine as claimed in claim 8, further comprising a thread take-up lever that moves vertically upward to tighten an upper thread loop around a lower thread, the retracted feed dog drive member driving the feed dog to move upward with a portion of upward movement of the thread take-up lever.

13. A sewing machine as claimed in claim 12, further comprising a loop taker disposed below the feed dog, the loop taker forming the upper thread loop and passing the lower thread through the upper thread loop, the retracted feed dog drive member driving the feed dog to move away from the loop taker with a portion of upward movement of the thread take-up lever.

14. A sewing machine as claimed in claim 13, wherein the loop taker is a vertical axis oscillating shuttle.

15. A sewing machine as claimed in claim 8, further comprising a thread take-up lever that moves vertically up and down, the retracted feed dog drive member driving the feed dog to move downward with a portion of upward movement of the thread take-up lever.

16. A sewing machine as claimed in claim 8, wherein the feed dog vertical drive member and the retracted feed dog drive member are provided integrally to a substantially circular drive cam that is driven to rotate about an imaginary axial center of the circular drive cam, the feed dog vertical drive member being formed with a vertical drive cam and the retracted feed dog drive member being formed with a retracted drive cam, the vertical drive cam and the retracted drive cam being substantially concentric about the imaginary axial center.

17. A sewing machine as claimed in claim 16, wherein the feed dog vertical drive unit further includes:

a follower that selectively follows one of the vertical drive cam and the retracted drive cam;

a mechanism that transmits drive force generated by the follower following the one of the vertical drive cam and the retracted drive cam to the feed dog; and a switching mechanism for switching the follower into confrontation with a selected one of the vertical drive cam and the retracted drive cam.

18. A sewing machine as claimed in claim 17, wherein the vertical drive cam and the retracted drive cam are formed with connection portions that are coplanar with each other to facilitate switching of the follower into confrontation with a selected one of the vertical drive cam and the retracted drive cam.

19. A sewing machine comprising:

a needle plate with an upper surface;

a feed dog;

a feed dog retraction mechanism that switches the feed dog into a retracted condition wherein the feed dog is retracted below a level of the upper surface of the needle plate; and a feed dog vertical drive unit that drives vertical movement of the feed dog, the feed dog vertical drive unit having a retracted feed dog drive unit that drives the feed dog to move vertically while in the retracted condition into which the feed dog is switched by the feed dog retraction mechanism, the retracted feed dog drive unit driving the feed dog to move upward when an upper thread is being pulled taught.

20. A sewing machine as claimed in claim 19, further comprising a vertical axis oscillating shuttle disposed beneath the feed dog and the needle plate.

* * * * *